US007963456B2

(12) United States Patent
Stadlbauer

(10) Patent No.: US 7,963,456 B2
(45) Date of Patent: Jun. 21, 2011

(54) TRACK PART AND FASTENING ELEMENT FOR TOY CAR RACING TRACK

(75) Inventor: Andreas Stadlbauer, Elsbethen (AT)

(73) Assignee: Stadlbauer Marketing + Vertrieb GmbH, Puch/Salzburg (AU)

( * ) Notice: Subject to any disclaimer, the term of this patent is extended or adjusted under 35 U.S.C. 154(b) by 352 days.

(21) Appl. No.: 12/093,221

(22) PCT Filed: Oct. 10, 2006

(86) PCT No.: PCT/EP2006/009778

§ 371 (c)(1),
(2), (4) Date: May 9, 2008

(87) PCT Pub. No.: WO2007/054172

PCT Pub. Date: May 18, 2007

(65) Prior Publication Data

US 2008/0265049 A1 Oct. 30, 2008

(30) Foreign Application Priority Data

Nov. 11, 2005 (DE) ..... 20 2005 017 673 U

(51) Int. Cl.
*E01B 23/00* (2006.01)

(52) U.S. Cl. ..... 238/10 F

(58) Field of Classification Search ..... 238/10 R, 238/10 A, 10 B, 10 E, 10 F
See application file for complete search history.

(56) References Cited

U.S. PATENT DOCUMENTS

| | | | | |
|---|---|---|---|---|
| 3,228,607 | A | 1/1966 | Robinette et al. | |
| 4,504,012 | A * | 3/1985 | Fetty et al. | 238/10 F |
| 5,405,080 | A * | 4/1995 | Yeung et al. | 238/10 F |
| 2003/0216186 | A1 | 11/2003 | Reisher et al. | |

FOREIGN PATENT DOCUMENTS

| | | | |
|---|---|---|---|
| DE | 29604885 | U1 | 6/1996 |
| DE | 10129275 | A1 | 1/2003 |

* cited by examiner

*Primary Examiner* — S. Joseph Morano
*Assistant Examiner* — Robert J McCarry, Jr.
(74) *Attorney, Agent, or Firm* — DeLio & Peterson, LLC; Robert Curcio

(57) ABSTRACT

The invention relates to a track part (10) for a lane-guided toy car racing track, which, on at least one end face (18), has a fastening device for a further track part (10), wherein the fastening device has at least one first pocket (22) and at least one pin (20) that fits into the first pocket (22), which are arranged symmetrically to one another with respect to a center (24) of the end face (18), such that, when two track parts (10) are inserted together, one pin (20) engages in a first pocket (22) in each case. The fastening device additionally has at least one pair (28) of second pockets (30), which are arranged symmetrically with respect to the center (24) of the end face (18), such that, when two track parts (10) are inserted together, two second pockets (30) come into contact with each another in each case.

6 Claims, 7 Drawing Sheets

TRACK PART AND FASTENING ELEMENT FOR TOY CAR RACING TRACK

Figure 1:
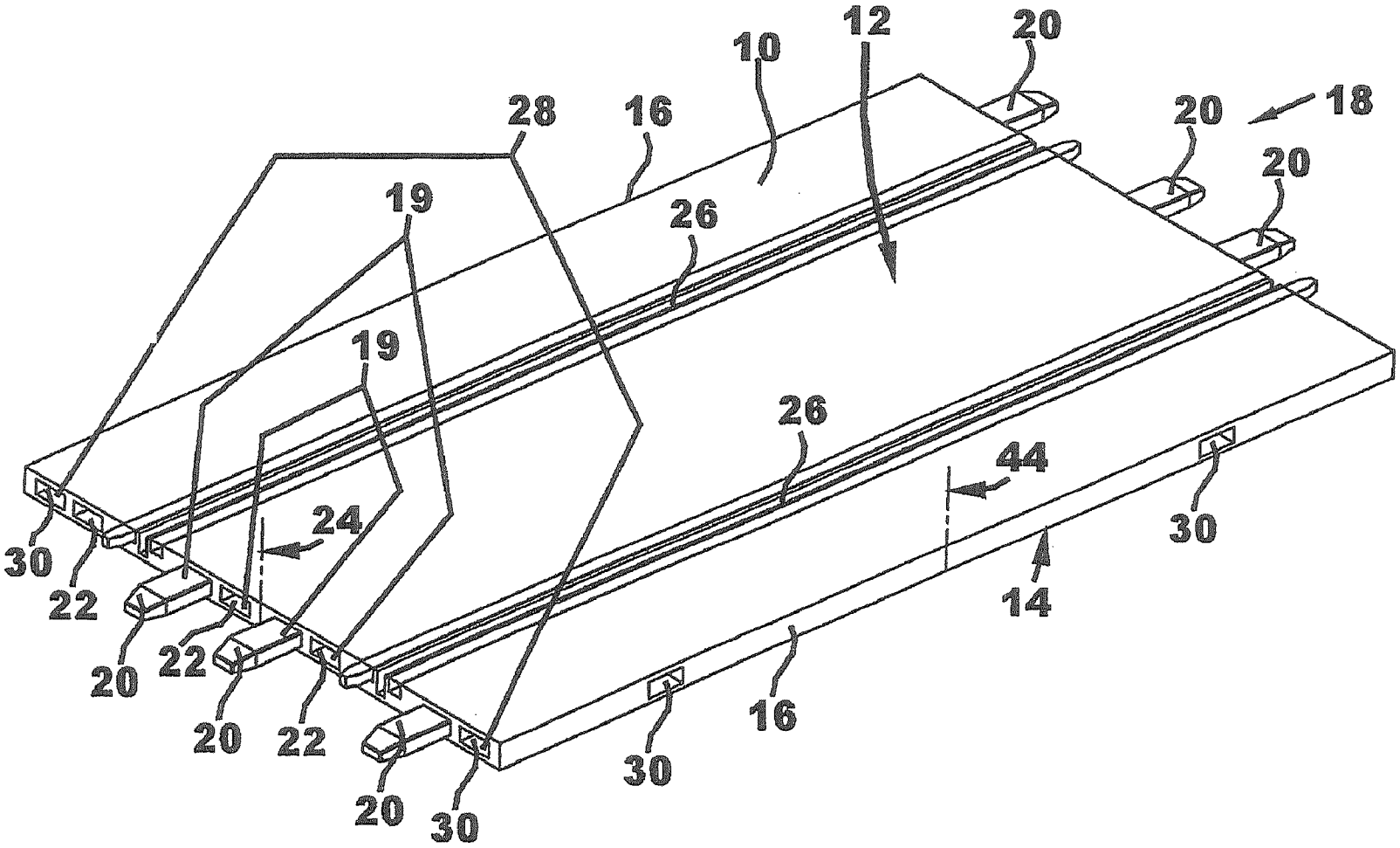

The present invention relates to a track part for a lane-guided toy car racing track, which, on at least one end face, has a fastening device for a further track part, wherein the fastening device has at least one first pocket and at least one pin that fits into the first pocket, which are arranged symmetrically to one another with respect to a center of the end face, such that, when two track parts are inserted together, one pin engages in a first pocket in each case, according to the preamble of claim 1. The invention further relates to a fastening element for an aforementioned track part for axially securing two track parts that have been inserted together against unintentional detachment of the inserted track parts, the fastening element having a first inserted part for joining to a first track part and a second inserted part for joining to a second track part that is inserted in the first component part, according to the preamble of claim 6.

[1] [Translator's Note] sic

Known for lane-guided toy car racing tracks are generic track parts. Said track parts have the advantage that all track parts can be designed identically on the end face with respect to the fastening device and nonetheless can be inserted into one another owing to the symmetry of pockets and pins. The pockets and pins engaging in one another ensure a correct alignment of the track parts when they are inserted together, so that the grooves of the track parts are flush with one another and provide a continuous lane guide for toy vehicles. In a certain way, the pockets and pins engaging in one another also provide a resistance against unintentional detachment of mutually inserted track parts in the axial direction, that is, in the direction of insertion.

However, it has been found that an additional securing against unintentional detachment of mutually inserted track parts in the axial direction is advantageous because, during operation of the toy car racing tracks, [owing to] vibrations due to the vehicles, which travel fast and often change their speed, an axial detachment of mutually inserted track parts is to be observed.[2] Already known, therefore, is to provide U-shaped clips on the bottom side facing away from the track way of the track parts, one arm of which is inserted in each of two neighboring track parts,[3] so that these clips act to oppose forces on the track parts in the axial direction, that is, against the direction of insertion. These clips are to be inserted manually into the toy car racing track made up of several track parts. In so doing, a problem is posed by the fact that the user cannot directly see the clips for insertion and withdrawal, because the clips are to be attached or removed on the bottom part of toy car racing tracks that have already been inserted together. Therefore, the user must rely solely on his or her sense of touch, so that setting up and taking apart toy car racing tracks necessitates a certain practice.

[2] [Translator's Note] The German original is flawed grammatically. The correct wording of the sentence is inferred.

[3] Ditto

The invention is based on the problem of improving a track part and a fastening element of the aforementioned kind such that setting up and taking apart toy car racing tracks made up of several track parts can be effected in an even more simple and faster manner.

This problem is solved in accordance with the invention by a track part of the aforementioned kind with the features characterized in claim 1 and by a fastening element of the aforementioned kind with the features characterized in claim 6. Advantageous embodiments of the invention are described in the further claims.

Provided according to the invention for a track part of the aforementioned kind is that the fastening device additionally has at least one pair of second pockets, which are arranged symmetrically with respect to the center of the end face, so that, when two track parts are inserted together, two second pockets come into contact with each other in each case.

This has the advantage that two mutually inserted track parts can be joined to each other by means of the fastening elements introduced into the second pockets, so that an unintentional detachment of the track parts during operation is effectively prevented.

In a preferred embodiment, the second pocket is designed so as to be open at both ends in the axial direction.

In order to fasten two track parts to each other from the side—for example, in order to construct a four-lane or multilane toy car racing track from the track parts or in order to attach edge strips to a track part with guide grooves so as to widen the toy car racing track, the track part additionally has a pair of second pockets on at least one lengthwise side, which are arranged symmetrically with respect to a center of the lengthwise side.

The track part is, for example, a track way part having at least one groove, in particular two grooves, for lane guiding of one toy vehicle in each case, each groove being assigned electrical conductors for power supply of the respective toy vehicle.

The track part is, for example, also an edge strip for widening the track way of the toy car racing track.

Provided according to the invention for a fastening element of the aforementioned kind is that the two inserted parts of the fastening element are each designed and arranged with respect to each other in such a way that each inserted part of a fastening element can be introduced by insertion into one of two second pockets that come into contact with each other and that each inserted part of the fastening element has a locking mechanism, which locks in place with the respective second pocket in a detachable manner in such a way that a pulling out of the fastening element from the second pocket in the axial direction is prevented.

This has the advantage that mutually inserted track parts can be joined together simply and reliably by using the fastening elements and, by simple release of the locking mechanism, the track parts can be separated once again from one another simply and quickly.

A simple mechanical locking with good accessibility of the locking mechanism for releasing the lock is achieved in that the releasable locking mechanism of each inserted part of the fastening element comprises an elastically deflectable spring catch tongue having a stop edge pointing in the direction of the other respective inserted part, the catch tongue being designed so as to be longer than an axial length of the second pocket and so that a distance between the stop edges of the catch tongues of the two inserted parts of a fastening element is equal to or greater than twice the axial length of a second pocket. The catch tongue can hereby be felt by a person even without visual contact and released by simply depressing it, an operation with one finger of one hand being sufficient, so that there results an especially simple and quick ability to release the locking mechanism with, at the same time, a high certainty against an unintentional detachment.

The invention will be illustrated in greater detail below on the basis of the drawing. Shown therein is:

FIG. 1 a preferred embodiment of a track part according to the invention in a perspective view from above, FIG. 2 the track part of FIG. 1 in perspective view from below, FIG. 3 a preferred embodiment of a fastening element according to the invention in plan view, FIG. 4 the fastening element of FIG. 3 in side view, FIG. 5 the fastening element of FIG. 3 in sectional view, FIG. 6 two mutually inserted track parts with fastening elements in exploded illustration, and FIG. 7 two mutually inserted track parts with fastening elements in a view from below.

Figure 2:
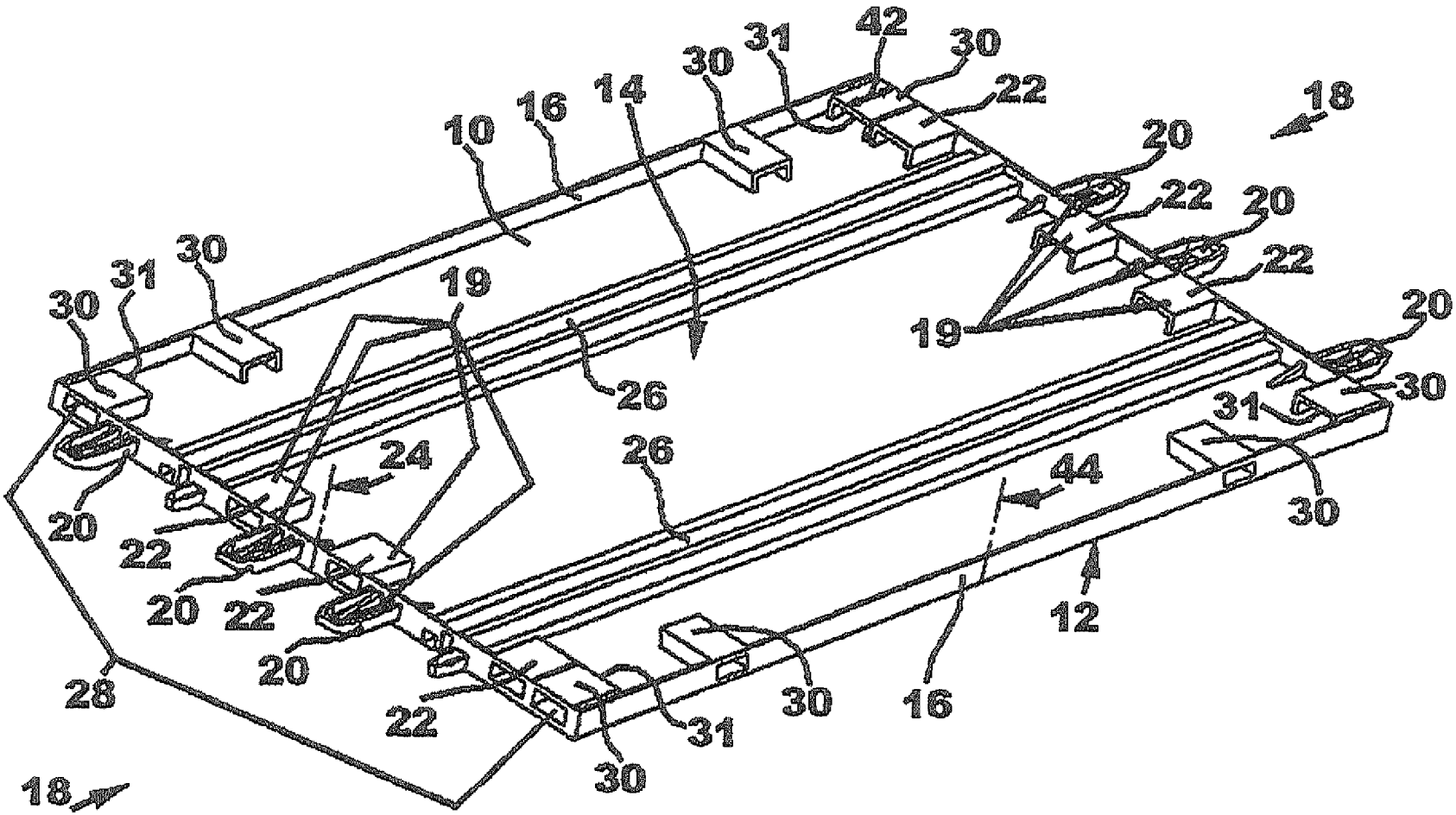

The preferred embodiment of a track part 10 according the invention, as seen from FIGS. 1 and 2, comprises a top side 12, which forms the track way, a bottom side 14, lengthwise sides 16, and end faces 18. The end faces 18 serve for inserting together two identical track parts 10 and each have a fastening device, which comprises three pairs 19 consisting of pin 20 and first pocket 22. The pin 20 and the first pocket 22 of each pair 19 are arranged here symmetrically with respect to a center 24 of the end face 18. It is hereby ensured that, when two identical track parts are inserted together, one pin 20 always makes contact with one first pocket 22, as seen from FIGS. 6 and 7. The pins 20 are designed here in such a way that they fit into the first pockets 22, so that, when two track parts 10 are inserted together, the pins 20 insert into the first pockets 22. These pairs 19 consisting of pins 20 and first pockets 22 ensure that grooves 26, arranged on the top side or track way side 12 of the track part 10, are precisely flush with the grooves 26 of an inserted track part 10, so that, in the mutually inserted state, the track parts 10 form a continuous track way with continuous grooves as lane guides for toy vehicles (not illustrated). For lane guiding, keels on the toy vehicles engage in a known way in the grooves 26.

Additionally provided in accordance with the invention is a pair 28 of second pockets 30 on the end face 18, the second pockets 30 of a pair 28 being arranged symmetrically with respect to the center 24 of the end face 18. It is hereby ensured that, when two track parts 10 are inserted together, two second pockets 30 come into contact with each other in each case, as seen from FIGS. 6 and 7. The pair 28 of second pockets 30 is arranged here on the end face 18 as outermost pair, so that the two second pockets 30 are situated at the corner of end face 18 and lengthwise side 16. In addition, two second pockets 30 are designed so as to be open at an end 31 facing away from the end face 18. A length of the second pocket 30 is designated by 42.

Figure 3:
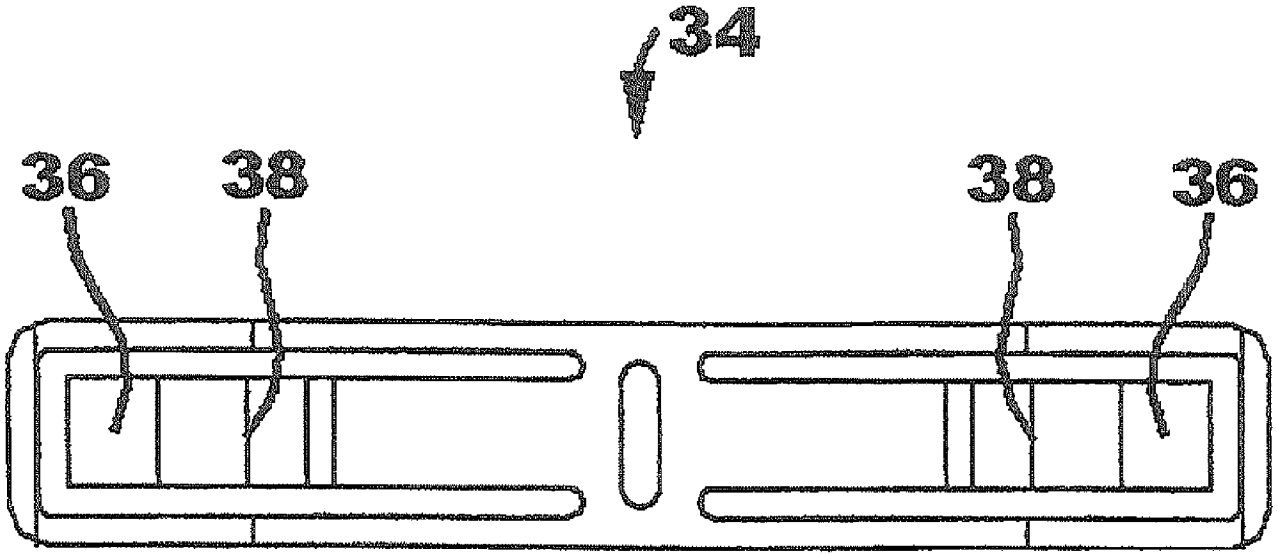
Figure 4:
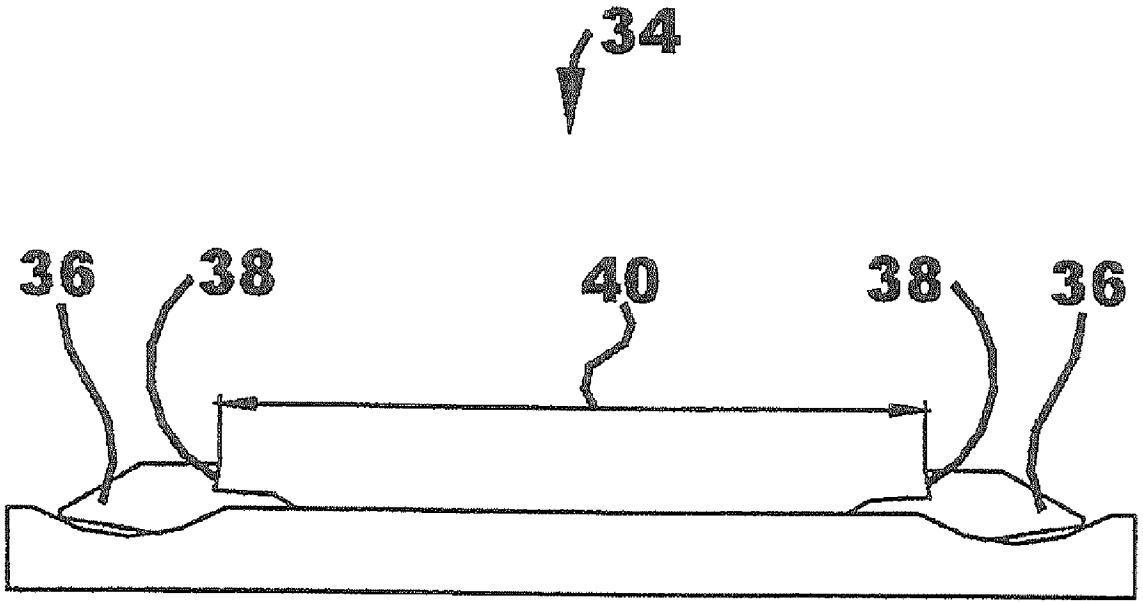
Figure 5:
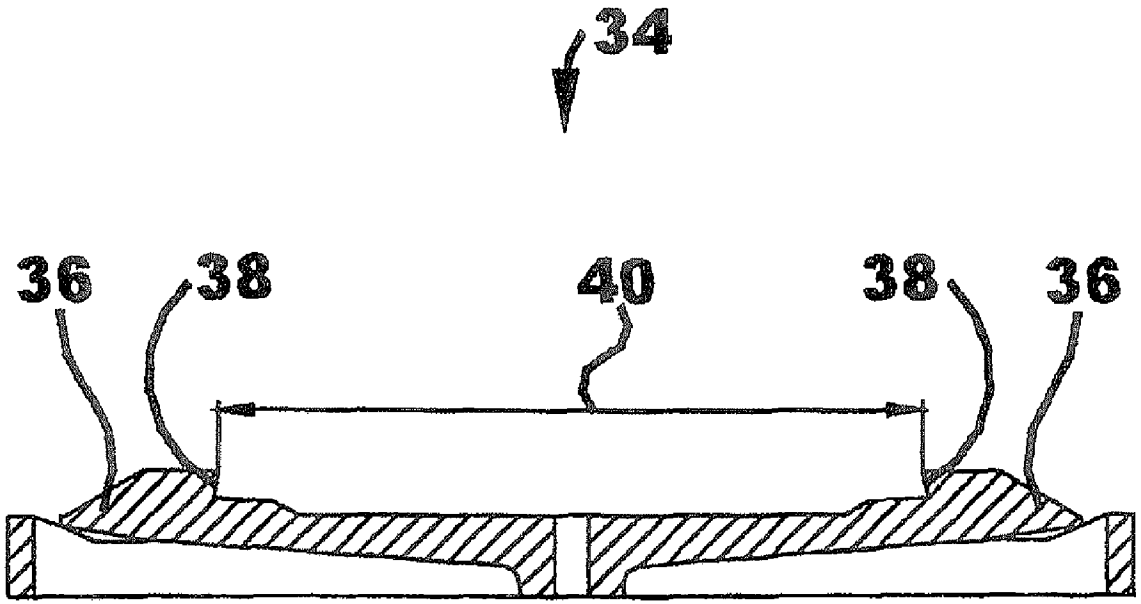
Figure 6:
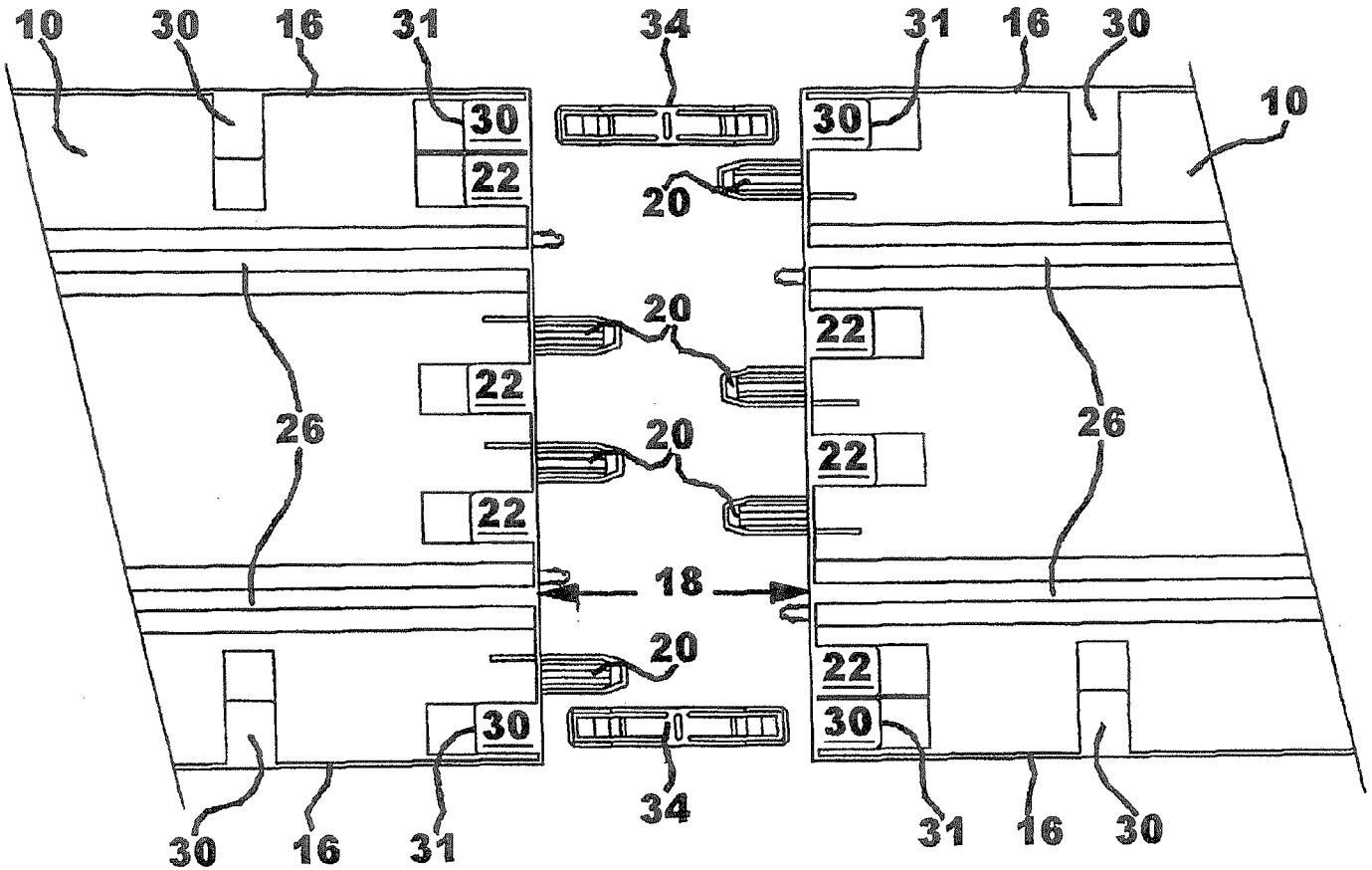

Further provided in accordance with the invention is a fastening element 32, a preferred embodiment of a fastening element 32 according to the invention being seen from FIG. 3 to 5. This fastening element 32 comprises two inserted parts 34, which each are designed in a fitting manner so as to engage in a second pocket 30. The inserted parts 34, with their respective lengthwise axes placed flush with one another, create the fastening element 32. Each inserted part 34 comprises an elastically deflectable spring catch tongue 36 having a stop edge 38. The stop edges 38 are each aligned in the direction of the other inserted part 36. In other words, the stop edges 38 of the catch tongues 36 of the inserted parts 34 of a fastening element 32 face one another. Each catch tongue 36 and each inserted part 34 is designed so as to be longer than an axial length of the second pockets 30. In this way, an inserted part 26 engages completely through an inserted part 26 of a second pocket 30 and additionally projects from the open end 31, facing away from the end face 18, of the second pocket 30. The catch tongues 36 are designed in such a way that, when the inserted part 34 is inserted into a second pocket 30, they are deflected against an elastic spring force. Once the inserted part 34 has been inserted sufficiently far into the second pocket 30 that the stop edge 38 reaches the open end 31, the elastic spring force presses the catch tongue back in the direction of its resting position and the stop edge 38 locks in place at the open end 31 of the second pocket 30.

The distance 40 between two mutually facing stop edges 38 of a fastening element 32 is equal to or greater than twice the length 42 of a second pocket 30. In this way, the two stop edges 38 of a fastening element 32 lock in place at the open ends 31 of the second pockets 30, which come into contact with one another when two track parts 10 are inserted together, as seen from FIG. 7. By means of this engagement of the stop edges 38 and the open ends 31 of second pockets 30 that come into contact with one another, each fastening element 32 holds the mutually inserted track parts 10 together.

Figure 7:
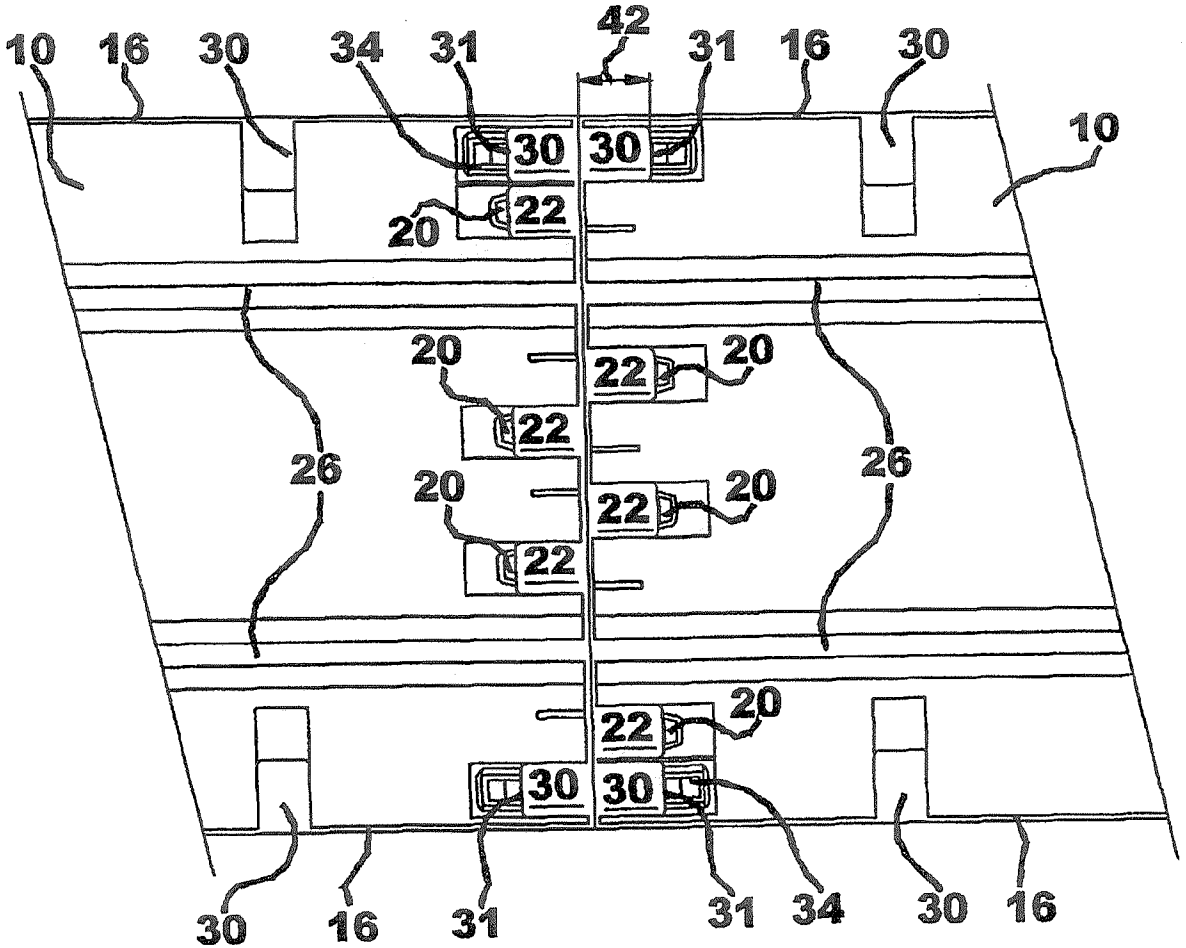

As seen directly from FIG. 7, the catch tongues 36 that are locked in place on the bottom side 14 of the track parts 10 are freely accessible. Therefore, in order to separate the track parts 10, it is possible in a simple way to press the catch tongues with one finger of one hand in the direction of the top side 12 of the track part 10 against the elastic spring force and thereby to release the engagement between the stop edge 38 and the open end 31. In addition, the fastening element 32 can be somewhat shifted in position after the release of the engagement, so that the catch tongue 36 lies within the second pocket 30 and does not spring back into engagement with the open end 31. In this way, the hand of a person operating the locking mechanism is once again free and the operating person can pull apart the track parts 10. Owing to the open accessibility of the catch tongues 36 on the bottom side 14 of the track part 10, this locking mechanism can be operated in a simple and reliable manner, even though, as a rule, the operating person does not have visual contact with the locking mechanism. However, the locking mechanism is easily and clearly felt on the bottom side 14 of the track part 10 and therefore does not necessitate special practice or experience for quick and simple release of the catch connection.

In order to join two track parts 10 to each other side by side for setting up a four-lane track, for example, a pair 28 of second pockets 30 is also designed on each lengthwise side 16 of the track part 10 and the fastening element 32 can lock in place in them in a corresponding way. The second pockets 30 of the pair 28 are also arranged symmetrically with respect to the center 44 of the lengthwise side 16.

The invention is illustrated above solely by way of example on the basis of a straight track part with two grooves as lane guide. However, it is self-evident that the second pockets 30 can also be arranged on track parts 10 in the form of curved parts, edge strips for widening a track way, or looping parts.

In the case of multilane toy car racing tracks, in which two or more track parts are to be joined with their lengthwise sides adjacent to one another, it was hitherto necessary to preassemble curve parts completely beforehand, because fixed pegs were provided on the track parts for locking them in place lengthwise and traversely. With the track parts 10 according to the invention, in combination with the novel fastening elements 32, this is no longer necessary, because, in place of fixed pegs, now, in accordance with the invention, the fastening elements 32, which can be introduced into the second pockets 30 on the lengthwise sides 16, even after the track parts 10 have been inserted together on lengthwise and end face sides, are provided for the traversely locking in place on the lengthwise sides 16. Therefore, four-lane and multilane tracks with two or more track parts 10 adjacent to one another can also be assembledsequentially from the track parts in curves with different curve radii for the different lane pairs and subsequently locked in place in the lengthwise and traverse direction.

The invention claimed is:

1. A track part for a lane-guided toy racing car comprising on at least one end face a fastening device for a complementary track part, said fastening device including at least one first pocket and at least one pin, such that when said track part is attached to said complementary track part said at least one pin from said track part engages within a pocket from said complementary track part and a pin from said complementary track part engages within said at least one first pocket from said track part, said fastening device further including at least one pair of second pockets centered symmetrically about said track part end face, such that, when said track part and said complementary track part are engaged, said at least one pair of second pockets align with second pockets of said complementary track part, wherein each second pocket includes a locking mechanism, wherein a fastening element for axially securing said track part and said complementary track part to prevent unintentional detachment, said fastening element comprising a first insert part for joining to said track part and a second insertion part for joining to said complementary track part, said insertion parts being designed and arranged with respect to each other to be inserted into said second pockets that come into contact with each other, and wherein each inserted part of said fastening element includes a releasable locking mechanism to lock in place with the locking mechanism of the second pockets in a detachable manner, so as to prevent a pulling out of said fastening element from said second pockets in the axial direction.

2. The track part of claim 1 including having said second pockets at both ends of said track part, said second pockets open in the axial direction.

3. The track part of claim 1 including having at least one groove for lane guiding of said toy racing car, said at least one groove including electrical conductors for supplying power to said toy vehicle.

4. The track part of claim 1 wherein said releasable locking mechanism of said insertion parts comprises an elastically deflectable spring catch tongue having a stop edge pointing in the direction of the other respective inserted part, said catch tongue being designed so as to be longer than an axial length of the second pocket such that a distance between stop edges of said catch tongues of the two insertion parts is equal to or greater than twice the axial length of a second pocket.

5. The track part of claim 1 including at least one pair of third pockets on at least one lengthwise side of said track part, said third pockets symmetrically centered with respect to said lengthwise side.

6. The track part of claim 1 including an attached second track part, attached lengthwise as an edge strip for track way widening.

* * * * *

UNITED STATES PATENT AND TRADEMARK OFFICE

CERTIFICATE OF CORRECTION

PATENT NO. : 7,963,456 B2
APPLICATION NO. : 12/093221
DATED : June 21, 2011
INVENTOR(S) : Andreas Stadlbauer It is certified that error appears in the above-identified patent and that said Letters Patent is hereby corrected as shown below:

Column 4, Line 64: Delete "assembledsequentially" therefore, substitute with -- assembled sequentially --

Signed and Sealed this
Eleventh Day of October, 2011

David J. Kappos

David J. Kappos
*Director of the United States Patent and Trademark Office*